United States Patent [19]

Ashton

[11] 4,009,500

[45] Mar. 1, 1977

[54] FLOOR SCRUBBING APPARATUS

[75] Inventor: Walter G. Ashton, Winnetka, Ill.

[73] Assignee: Star Industries, Inc., Highland Park, Ill.

[22] Filed: Apr. 26, 1976

[21] Appl. No.: 680,364

[52] U.S. Cl. ..... 15/50 R; 15/87

[51] Int. Cl.[2] ..... A47L 11/29

[58] Field of Search ..... 15/4, 49 R, 50 R, 79 A, 15/87, 320, 340

[56] References Cited

UNITED STATES PATENTS

| | | | |
|---|---|---|---|
| 3,639,936 | 2/1972 | Ashton | 15/4 |
| 3,701,177 | 10/1972 | Meyer et al. | 15/50 R |

*Primary Examiner*—Edward L. Roberts

*Attorney, Agent, or Firm*—Edward C. Threedy

[57] ABSTRACT

An operator-driven, self-propelled, floor scrubbing and sweeping apparatus having a wheeled frame and a floor cleaning unit mounted thereon consisting of a support for positioning a set of brushes, as well as a refuse receptacle, beneath the frame, including hydraulic means for raising and lowering the support, together with the brushes and the receptacle, relative to the frame, into and out of floor cleaning positions.

8 Claims, 7 Drawing Figures

FLOOR SCRUBBING APPARATUS

SUMMARY OF THE INVENTION

This invention relates to a floor scrubbing apparatus for cleaning and maintaining large areas of floor space on a suitable commercial basis, and more particularly this invention relates to an improved form of such floor scrubbing apparatus.

In order to properly clean and maintain large floor areas which are present in office buildings, factories, warehouses, airports, and the like, it has become common practice to utilize apparatuses of the general category of the present invention, that is, floor scrubbing apparatuses which are operator-driven. While machines of this general category have been well known in the prior art and are familiar to those skilled in the art of floor maintenance, there nevertheless have been several disadvantages associated with the prior art form of floor scrubbing machines, which are related to the construction, operation, maintenance, and versatility thereof.

The apparatus of this invention is adapted to be self-propelled, and for that purpose a single, steerable, front, power-driven wheel of the type shown, described and claimed in U.S. Pat. No. 3,701,177 dated Oct. 31, 1972, may be employed. The present apparatus discloses an arrangement whereby a set of three scrubbing brushes may be triangularly positioned with respect to the drive wheel, thereby affording to the apparatus an enlarged working area without interference to the almost 360° turning radius of the steering wheel.

The three scrubbing brushes are carried by a V-shaped frame, with two of the brushes being positioned at the forward end of the frame to either side of the steering wheel, and with the third scrubbing brush positioned rearwardly thereof an equal distance between the front two scrubbing brushes. The frame is attached to a pair of tow bars which are pivotally connected to the frame of the vehicle, as well as to the V-shaped bars of the scrubbing brush support. These tow bars are in turn connected to lift bars which are an extension of a reciprocally movable piston of a hydraulic cylinder which, in effect, raises or lowers the entire brush support, thus raising and lowering the three brushes simultaneously from engagement with the floor surface.

By a suitable mounting arrangement, a refuse receptacle is pivotally carried such that when the V-shaped support of the brushes is raised and lowered, the receptacle will be pivoted about a horizontal axis together therewith, so as to prevent the loss of refuse collected thereby while the apparatus is being moved from one location to another.

GENERAL DESCRIPTION

The apparatus will be best understood by reference to the accompanying drawings, which show the preferred form of the invention whereby the objects thereof are achieved, and in which.

Figure 1:
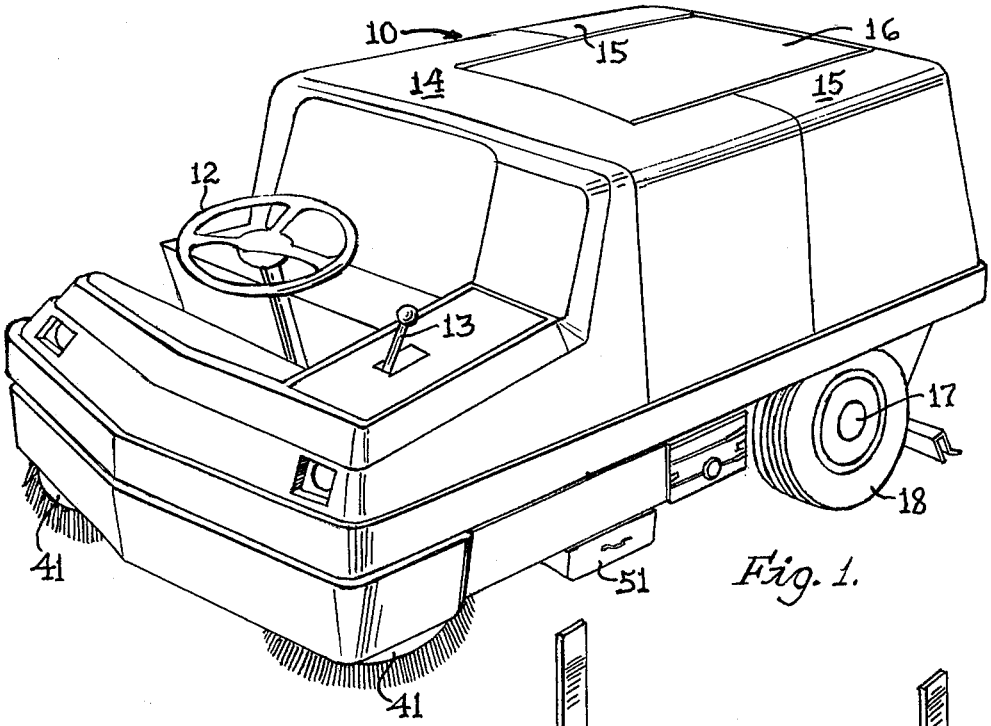
FIG. 1 is a perspective view of the floor scrubbing apparatus.

The floor scrubbing apparatus of this invention is adapted to consist of a wheeled vehicle 10 which provides a driver compartment 11 where there is conveniently available to the driver a steering wheel 12 as well as a control lever 13. The vehicle 10 comprises a recovery tank 14 as well as a pair of cleaning solvent tanks 15 mounted to either side of a motor compartment 16.

All of the latter identified structural parts of the vehicle 10 are mounted immediately above the rear axle 17, which freely supports a pair of rear wheels 18.

Figure 2:
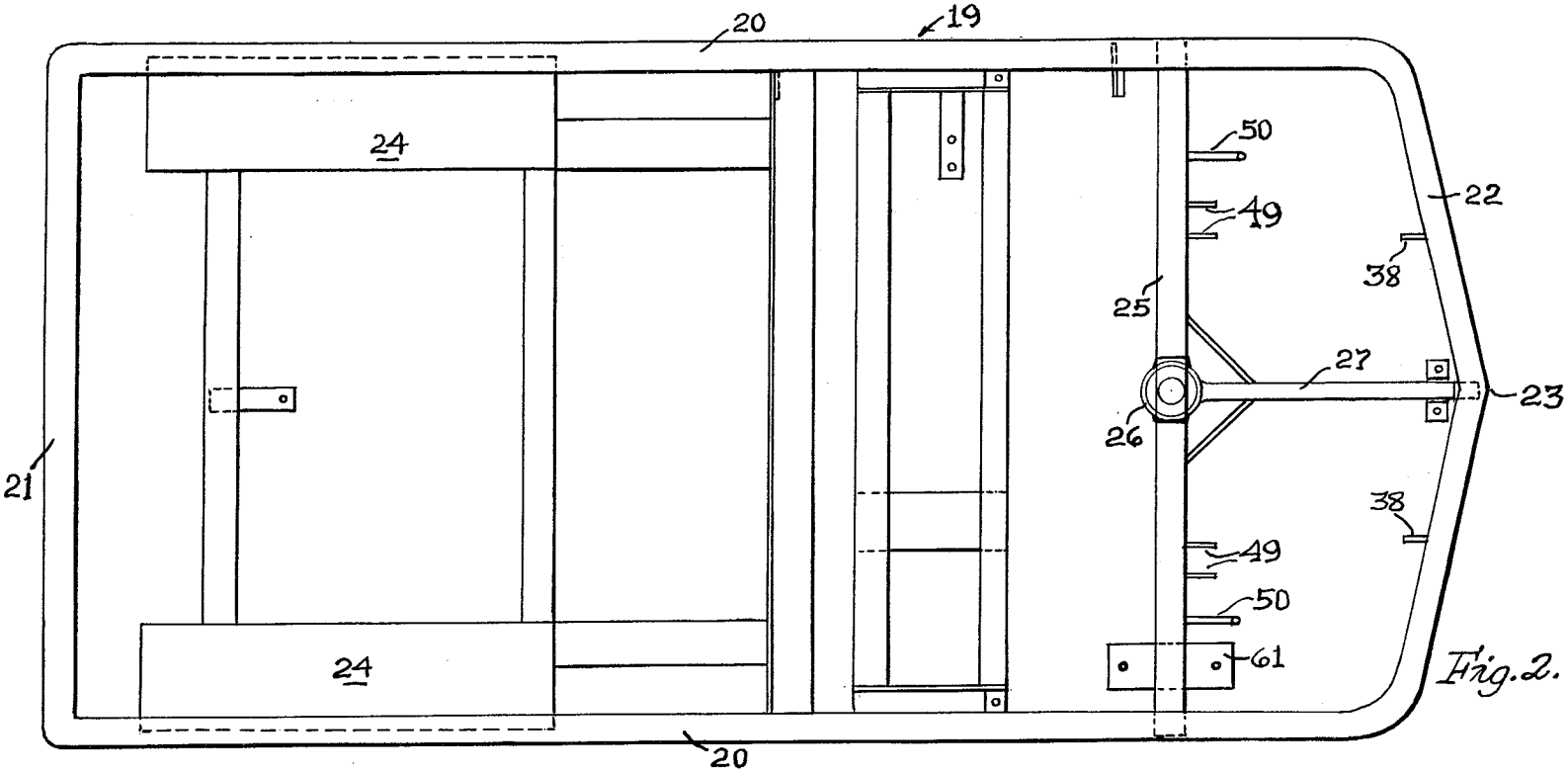
FIG. 2 is a top plan view of the frame for the wheeled floor scrubbing apparatus.
Figure 3:
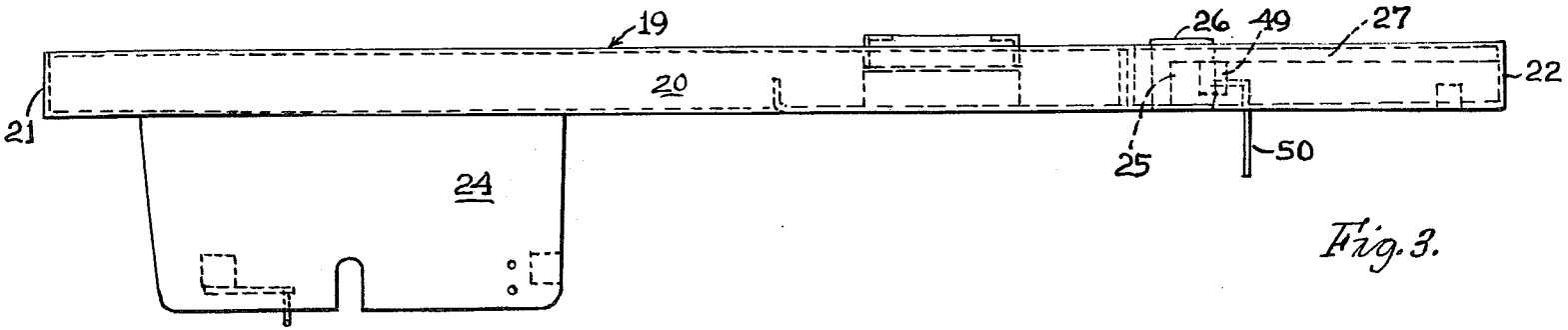
FIG. 3 is a side view of the frame shown in FIG. 2.

Referring to FIGS. 2 and 3, the vehicle 10 consists of a frame 19 having side rails 20 connected at one end by a rear rail 21 and at the other end by a front rail 22 which is formed to provide a forwardly projecting centerpoint 23. Within the frame 19 and supported by each of the side rails 20 are depending axle supports 24.

Adjacent to the forward end of the frame 19 there is a transversely extending brace 25 which provides a center bearing 26 through which the steering post of the front steerable wheel (not shown) projects.

The brace 25 by a center rail 27 is connected to the centerpoint 23 of the front rail 22 for added rigidity.

Figures 4, 5:
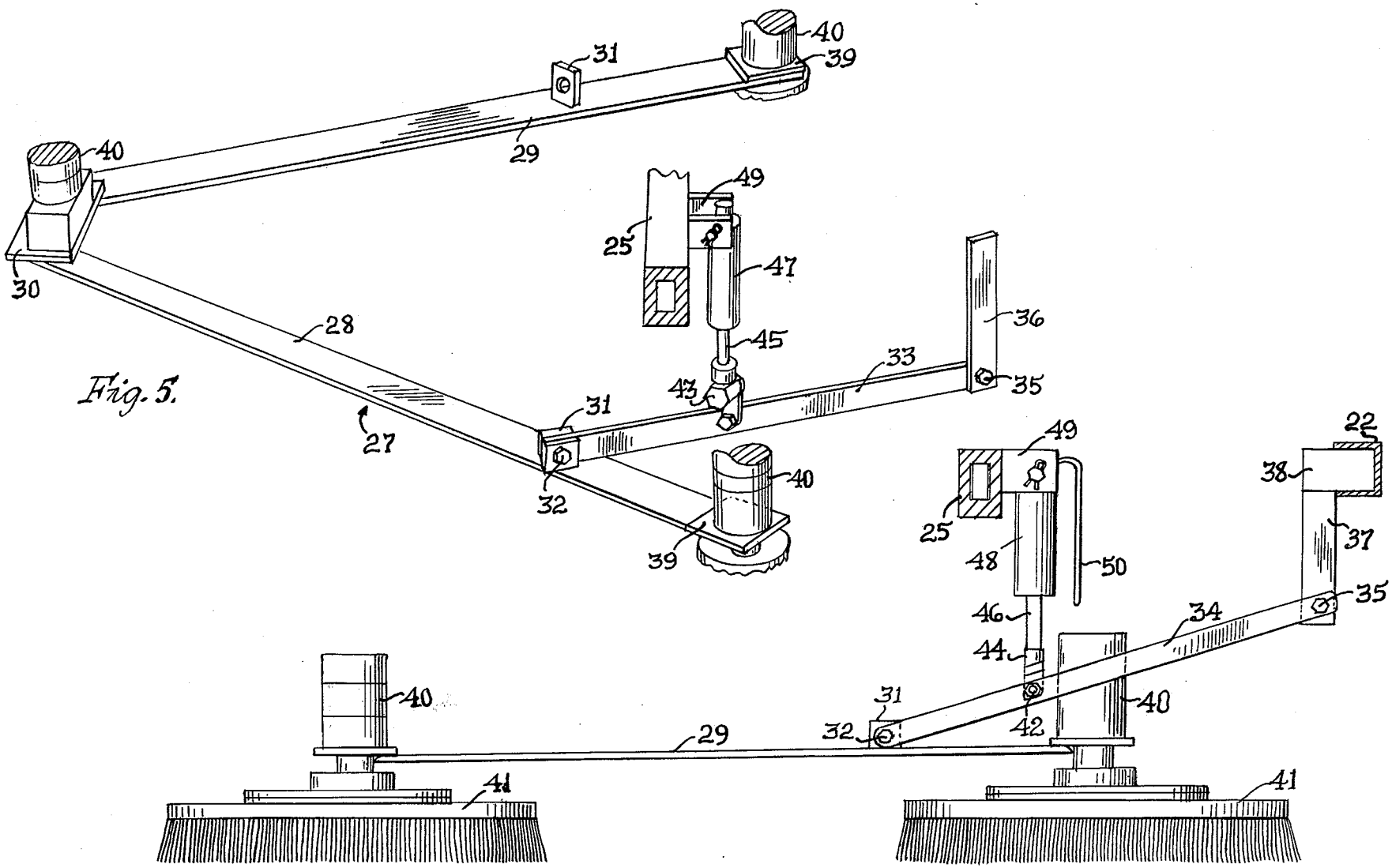
FIG. 4 is a fragmentary detailed side elevational view of the floor scrubbing brush support and moving mechanism.
FIG. 5 is a fragmentary detailed perspective view of the V-shaped frame for the scrubbing brushes.

The scrubbing brush arrangement of this invention is directed to positioning three rotary brushes relative to the front power-driven steering wheel, the latter not shown but described in the aforementioned patent. As such, the brush support 27 (as shown in FIGS. 4 and 5) consists of a pair of support bars 28 and 29 connected together at one end by a plate 30 so as to be positioned in a horizontally disposed V.

Strategically placed upon the upper surface of each of the support bars 28 and 29, is a lug 31. Each of the lugs 31 is angularly carried by its respective support bar 28, 29 so as to lie in a generally forwardly directed plane. Adapted to be pivotally connected as at 32 to each of the lugs 31, as a tow bar 33 and 34. Each of the tow bars 33–34 at its forward end is pivotally connected as at 35 to the depending end of a pair of draw bars 36 and 37, which in turn are each fixedly attached to a lug 38 carried by the front rail 22 to either side of the centerpoint 23.

The support bars 28 and 29, in addition to the plate 30 which connects their free ends together, provide, at their opposite free ends, like plates 39 which in turn support the hydraulic motors 40 which removably carry and rotate the scrubbing brushes 41. These hydraulic motors 40, as well as their scrubbing brushes 41, are of a well known construction constituting no part of the present invention except for their operative application to the overall invention.

The tow bars 33 and 34 are each pivotally connected as at 42 to lift bars 43 and 44, respectively. These lift bars 43 and 44 are extensions of the pistons 45 and 46 of a pair of hydraulic cylinders 47 and 48.

The hydraulic cylinders 47 and 48 have their respective opposite ends pivotally connected between a pair of lugs 49 carried by the brace 25. The hydraulic cylinders are adpated to be mounted together to a suitable dual control whereby they may be simultaneously activated to expel and retract their respective pistons 45 and 46.

The arrangement of the foregoing components is such that the scrubbing brushes 41 may be conveniently raised and lowered into and out of floor cleaning engagement by the operator of the apparatus. The brushes 41 will be raised and lowered simultaneously by the arrangement of the components as described.

In order to assure proper movement of the brushes 41 into and out of floor scrubbing arrangement, it should be noted that the tow bars 33 and 34 are connected to the support bars 28 and 29 at a point along the length thereof so that there will be a counterbalance between the weight of the two forward scrubbing brushes 41 relative to the rear scrubbing brush 41, such that the support bars 28 and 29 are moved through a relatively vertical plane while remaining in their general horizontal plane.

However, a situation may arise where the apparatus will collect an abnormal amount of heavy debris in the refuse container 51 to be hereinafter described, which would thereby increase the weight at the rearward end of the support 27, which may in turn cause the rear scrubbing brush 41 to seek a lower plane than that of the forward brushes 41. To prevent this condition, there are provided two depending stops 50 carried by the center brace 25. The free ends of the stops 50 are positioned in a spaced vertical relation with respect to the tops of the hydraulic motors 40 of each of the forward scrubbing brush units, as seen in FIG. 4. Thus, when the hydraulic cylinders 47–48 raise the brush support 27, the motors 40 of the front brushes 41 will engage the stops 50 and thereafter any continuing movement of the pistons 45–46 of the cylinders 47–48 will cause an additional pivotal movement of the rear brush 41 in an upward direction.

Figure 6:
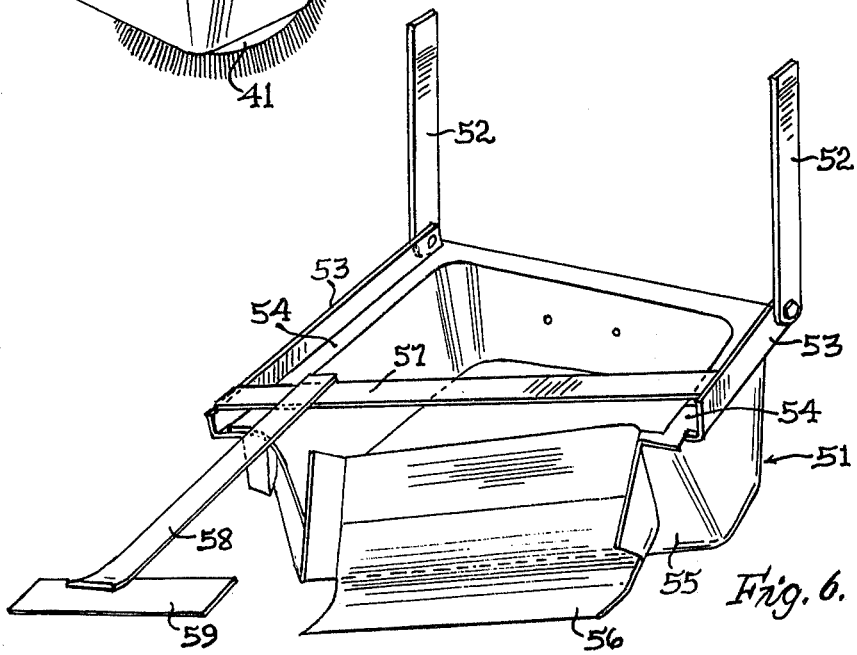
FIG. 6 is a perspective view of the refuse receptacle and its support.

The floor scrubbing apparatus is so arranged that the two forward scrubbing brushes 41 will have counter rotational movement such that they will feed into the center position therebetween any loose debris. This will place the debris in the path of the rear scrubbing brush 41 which is adapted to be rotated in a clockwise direction so that such loose debris is forcibly fed into a refuse receptacle shown in FIGS. 1 and 6.

The receptacle 51 is removably mounted on a supporting frame which consists of a pair of depending bars 52 carried by one of the side rails 20 of the frame 19. These bars 52 at their free end pivotally carry a pair of L-shaped rails 53, which in turn support the peripheral edge flange 54 of the receptacle 51. The inwardly disposed side wall 55 of the receptacle 51 is cut out and formed to receive a deflector plate 56 which faces to one side of the rear scrubbing brush 41.

The receptacle 51 is provided with a means whereby it can be tilted about the pivotal connections between the rails 53 and the depending legs 52. This means comprises a crossbar 57 which extends between the inwardly disposed ends of the rails 53. This crossbar 57 in turn supports an inwardly directed arm 58 which in turn at its free end carries a shoe 59. The shoe 59 is adapted to engage and rest upon the support bar 29 adjacent to its connection to the plate 30.

By this arrangement, when the hydraulic cylinders 47 and 48 are activated to raise the support 27, the following movement of the support bar 29 will in turn tilt the receptacle 51 about the pivotal connections between the rails 53 and the depending legs 52. This movement raises the deflector plate 56 away from the floor and prevents the debris within the refuse receptacle 51 from spilling out when the scrubbing brushes are so raised and the vehicle is being moved across the floor area.

There is also provided a side squeegee 60 which is associated with the right front scrubbing brush 41 of the apparatus. This squeegee 60 is carried by a support, the components of which are arranged to form and function as a parallelogram. As such, carried by the brace 25 is a first plate 61. Pivotally connected to the ends of the first plate 61 are a pair of parallelly extending arms 62. These arms 62 are in turn pivotally connected to the top flange 63 of an angle bar 64 which in turn supports the rubber squeegee member 65. Adjacent one end of one of the arms 62 is a lug 66 having an aperture formed in its free end which freely receives the curved end 67 of a control rod 68.

Figure 7:
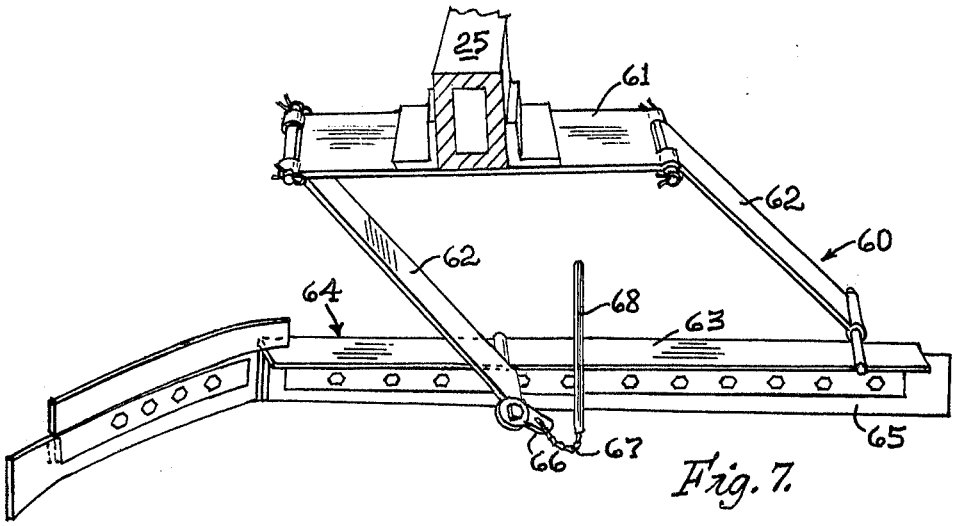
FIG. 7 is a fragmentary detailed perspective view of the front squeegee assembly.

The control rod 68 will project upwardly and be disposed in a convenient position within the driver compartment 11, where it may be manually operated by the operator of the vehicle 10. When the control rod 68 is pulled upwardly, as shown in FIG. 7, it will collapse the arms 62 in a manner so as to draw the flange 63 upwardly in the direction of the plate 61, at the same time swinging the squeegee assembly rearwardly beneath the frame 19.

From the foregoing, it will be apparent that I have described a floor scrubbing apparatus that is adapted to be operator-driven and one that is self-propelled. The invention resides in specifically placing the triangularly disposed scrubbing brushes about a single centrally located power-driven steering wheel for the vehicle. The triangular disposition of the scrubbing brushes affords the apparatus a large working area. Also included is a novel and convenient means for raising and lowering all of the scrubbing brushes into and out of floor cleaning engagement, such movement of the scrubbing brushes being simultaneous with the pivoting of the refuse receptacle strategically positioned with respect to one of the scrubbing brushes to collect and maintain loose debris engaged by the apparatus during its floor cleaning operation.

While I have illustrated and described the preferred form of construction for carrying my invention into effect, this is capable of variation and modification without departing from the spirit of the invention. I, therefore, do not wish to be limited to the precise details of construction set forth, but desire to avail myself of such variations and modifications as come within the scope of the appended claims.

Having thus described my invention, what I claim as new and desire to protect by Letters Patent is:

1. A floor scrubbing apparatus having an operator-driven wheeled vehicle including a single, front, steerable, drive wheel, wherein the improvement comprises a. a frame for the wheeled vehicle, b. a brush unit mounted on said frame so as to dispose a brush to either side of the front steerable drive wheel and a single brush rearwardly thereof, c. said brush unit providing a pair of brush supporting bars connected together at one end to form a horizontally disposed V-shaped arrangement, d. a pair of tow bars each pivotally connected to one of said brush support bars intermediate the ends thereof and to said frame, e. means carried by said frame and connected to said tow bars for pivoting the same relative to their connection to said frame for raising and lowering said brush unit, f. a refuse container carried by said frame adjacent to one of said brushes to collect debris swept by said brush, and g. means for mounting said container on said frame and for connection to said brush unit so that said container may be pivoted into a raised and lowered position together with said brush unit by said first-mentioned means.

2. A floor scrubbing apparatus as defined by claim 1, wherein said means for pivoting said tow bars relative to said frame comprises a pair of hydraulically operated cylinders having reciprocally movable pistons, each of said pistons being pivotally connected to a tow bar.

3. A floor scrubbing apparatus as defined in claim 1, including stop means carried by said frame and operable upon the brushes to either side of the steerable drive wheel for restricting movement thereof in one direction.

4. A floor scrubbing apparatus as defined by claim 3, wherein said means for pivoting said tow bars relative to said frame comprises a pair of hydraulically operated cylinders having reciprocally movable pistons, each of said pistons being connected to a tow bar.

5. A floor scrubbing apparatus as defined by claim 1, including a squeegee assembly movably carried by said frame and adapted to cooperate with one of said brushes to either side of the steerable drive wheel for directing fluid and debris into the path of the brush rearwardly of the wheel.

6. A floor scrubbing apparatus as defined by claim 5, wherein said means for pivoting said tow bars relative to said frame comprises a pair of hydraulically operated cylinders having reciprocally movable pistons, each of said pistons being pivotally connected to a tow bar.

7. A floor scrubbing apparatus as defined by claim 5, including stop means carried by said frame and operable upon the brushes to either side of the steerable drive wheel for restricting movement thereof in one direction.

8. A floor scrubbing apparatus as defined by claim 4, including a squeegee assembly movably carried by said frame and adapted to cooperate with one of said brushes to either side of the steerable drive wheel for directing fluid and debris into the path of the brush rearwardly of the wheel.

* * * * *